US008061710B2

(12) United States Patent
Chien et al.

(10) Patent No.: US 8,061,710 B2
(45) Date of Patent: Nov. 22, 2011

(54) BILL POSITION ADJUSTMENT METHOD AND SYSTEM FOR BILL ACCEPTOR

(75) Inventors: Tien-Yuan Chien, Taipei (TW); Hung-Yi Chang, Chilung (TW)

(73) Assignee: Internatinal Currency Technologies Corp., Taipei (TW)

( * ) Notice: Subject to any disclaimer, the term of this patent is extended or adjusted under 35 U.S.C. 154(b) by 251 days.

(21) Appl. No.: 12/327,812

(22) Filed: Dec. 4, 2008

(65) Prior Publication Data

US 2010/0140863 A1 Jun. 10, 2010

(51) Int. Cl.
*B65H 9/00* (2006.01)

(52) U.S. Cl. ..... 271/240; 271/234; 194/206; 194/207

(58) Field of Classification Search ..... 271/240, 271/234; 194/206, 207
See application file for complete search history.

(56) References Cited

U.S. PATENT DOCUMENTS 5,411,249 A * 5/1995 Zouzoulas ..... 271/181
7,240,780 B2 * 7/2007 Nago et al. ..... 194/206
7,469,894 B2 * 12/2008 Seto ..... 271/238
7,513,432 B2 * 4/2009 Chang ..... 235/486
7,762,547 B2 * 7/2010 Nireki ..... 271/240

FOREIGN PATENT DOCUMENTS

JP 01169590 A * 7/1989
JP 05294517 A * 11/1993

* cited by examiner

*Primary Examiner* — Stefanos Karmis
*Assistant Examiner* — Luis A Gonzalez
(74) *Attorney, Agent, or Firm* — Muncy, Geissler, Olds & Lowe, PLLC

(57) ABSTRACT

A bill position adjustment method and system for bill acceptor is disclosed to include a body with an insertion slot and a bill passage, a transmission mechanism for transferring an inserted bill, a recognition device for recognizing the authenticity and value of an inserted bill, an entrance sensor and a stoppage sensor mounted in the bill passage for controlling the transmission mechanism to transfer the inserted bill into position for recognition, a bill passage adjustment mechanism for adjusting the width of the bill passage to correct the direction of an inserted bill into accurate alignment with the recognition device, and a bill sensor mounted in a sensor zone in the insertion slot for detecting the width of an inserted bill and controlling the bill passage adjustment mechanism to adjust the width of the bill passage subject to the detection result.

5 Claims, 10 Drawing Sheets

BILL POSITION ADJUSTMENT METHOD AND SYSTEM FOR BILL ACCEPTOR

BACKGROUND OF THE INVENTION

1. Field of the Invention

The present invention relates to a bill acceptor for use with an automatic vending machine and more particularly, to a bill position adjustment method and system for bill acceptor, which automatically adjust the width of the bill passage to correct the direction of an inserted bill into accurate alignment with a recognition device for accurate recognition.

2. Description of the Related Art

Following fast development of technology, the distance among people has been greatly shortened, our mode of living has been changed, requesting convenience and rapidness. In consequence, different automatic vending machines, auto teller machines, bill acceptors and many other automatic service machines are developed and intensively used public places to serve people without serviceman. These automatic machines are highly invited for the advantage of saving much labor and bringing convenience to people.

Further, to avoid direct loss due to counterfeiting and to avoid inadvertently passing counterfeit bills to consumers, a bill acceptor has recognition means to recognize the authenticity of a bill before receiving it. However, the bill passage of a bill acceptor is specifically designed for a particular bill of one specific width. Because different bills issued from different countries have different sizes (length, width and thickness) and different anti-counterfeit characteristics at different locations. A bill that is inserted into a bill acceptor must be kept in accurate alignment with the recognition device so that the recognition device can accurate recognize the anti-counterfeit characteristics. If an inserted bill is biased, the recognition device may reject the bill due to a recognition error. In this case, the user must insert the bill again, causing inconvenience.

Further, after recognition of a bill to be a true bill, a transmission mechanism is controlled to transfer the bill to a bill box. If a bill is biased when it is being transferred to the bill box, it may be curved in the bill box, lowering the available space of the bill box, or jammed in the bill entrance of the bill box, causing a machine failure.

There is known a bill acceptor that has two clamping arms arranged at two opposite lateral sides of the bill passage and movable relative to each other for holding an inserted bill in accurate alignment with the recognition device. However, this design is still not satisfactory in function because of the following drawbacks:

1. The bill acceptor fits only one specific kind of bills having a specific width.
2. When a wrinkled and softened bill is inserted into the bill acceptor, the bill will be deformed after clamped by the two clamping arms, causing the recognition device unable to accurate recognize the anti-counterfeit characteristics of the bill or the transmission mechanism unable to transfer the bill positively.

Therefore, it is desirable to provide a bill acceptor that eliminates the aforesaid problems.

SUMMARY OF THE INVENTION

The present invention has been accomplished under the circumstances in view. It is therefore one object of the present invention to provide a bill position adjustment method and system for bill acceptor, which automatically adjusts the width of the bill passage to correct the direction of an inserted bill into accurate alignment with a recognition device for accurate recognition. It is another object of the present invention to provide a bill position adjustment method and system for bill acceptor, which automatically corrects the direction of an inserted bill without wrinkling the bill. It is still another object of the present invention to provide a bill position adjustment method and system for bill acceptor, which fits different kinds of bills having different sizes and different anti-counterfeit designs.

To achieve these and other objects of the present invention, the bill position adjustment system for bill acceptor comprises a body with an insertion slot and a bill passage, a transmission mechanism for transferring an inserted bill, a recognition device for recognizing the authenticity and value of an inserted bill, an entrance sensor and a stoppage sensor mounted in the bill passage for controlling the transmission mechanism to transfer the inserted bill into position for recognition, a bill passage adjustment mechanism for adjusting the width of the bill passage to correct the direction of an inserted bill into accurate alignment with the recognition device, and a bill sensor mounted in a sensor zone in the bill insertion slot for detecting the width of an inserted bill and controlling the bill passage adjustment mechanism to adjust the width of the bill passage subject to the detection result.

Further, the bill passage adjustment mechanism comprises at least one first adjustment device and at least one second adjustment device arranged at two opposite lateral sides of the bill passage and movable transversely relative to the bill passage to adjust the width between the at least one first adjustment device and the at least one second adjustment device, and a plurality of driving devices controllable to move the at least one first adjustment device and the at least one second adjustment device separately. Because the at least one first adjustment device and the at least one second adjustment device are separately moved to correct the direction of an inserted bill, correcting the direction of an inserted bill does not wrinkle or deform the bill.

DETAILED DESCRIPTION OF THE PREFERRED EMBODIMENT

Figure 1:
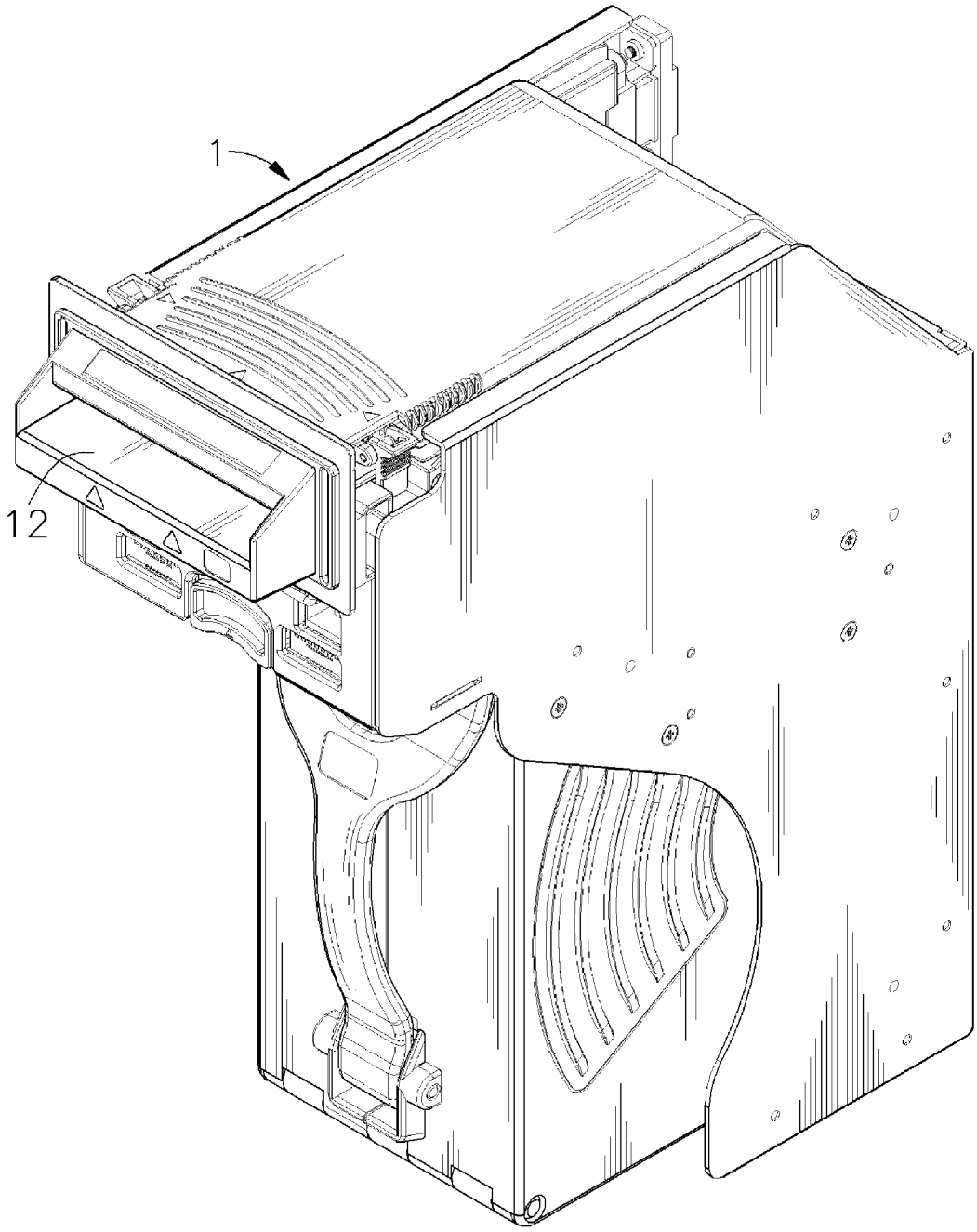
FIG. 1 is an elevational view of a bill acceptor equipped with a bill position adjustment system in accordance with the present invention.
Figure 2:
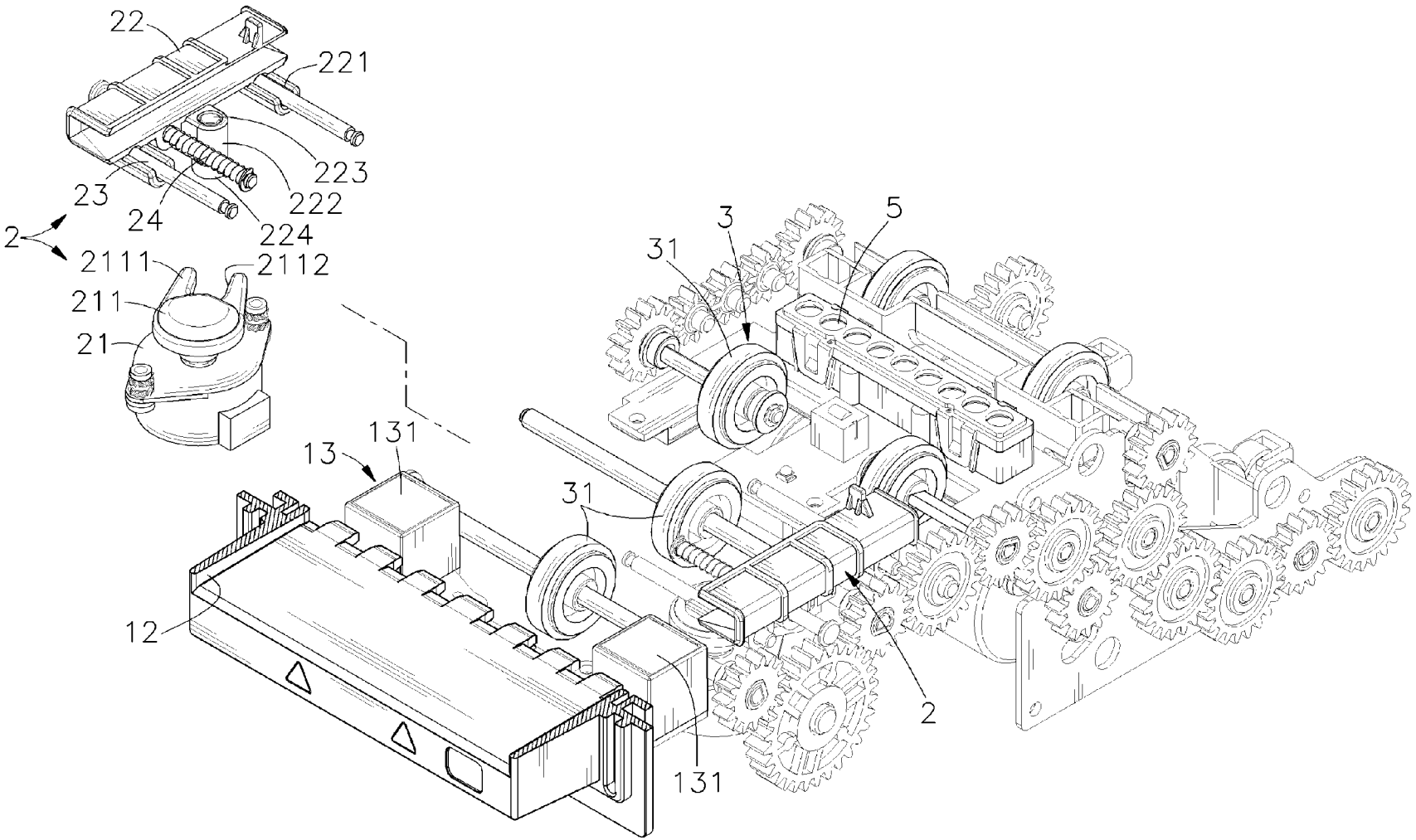
FIG. 2 is an exploded view in an enlarged scale of a part of the bill position adjustment method and system in accordance with the present invention.
Figure 3:
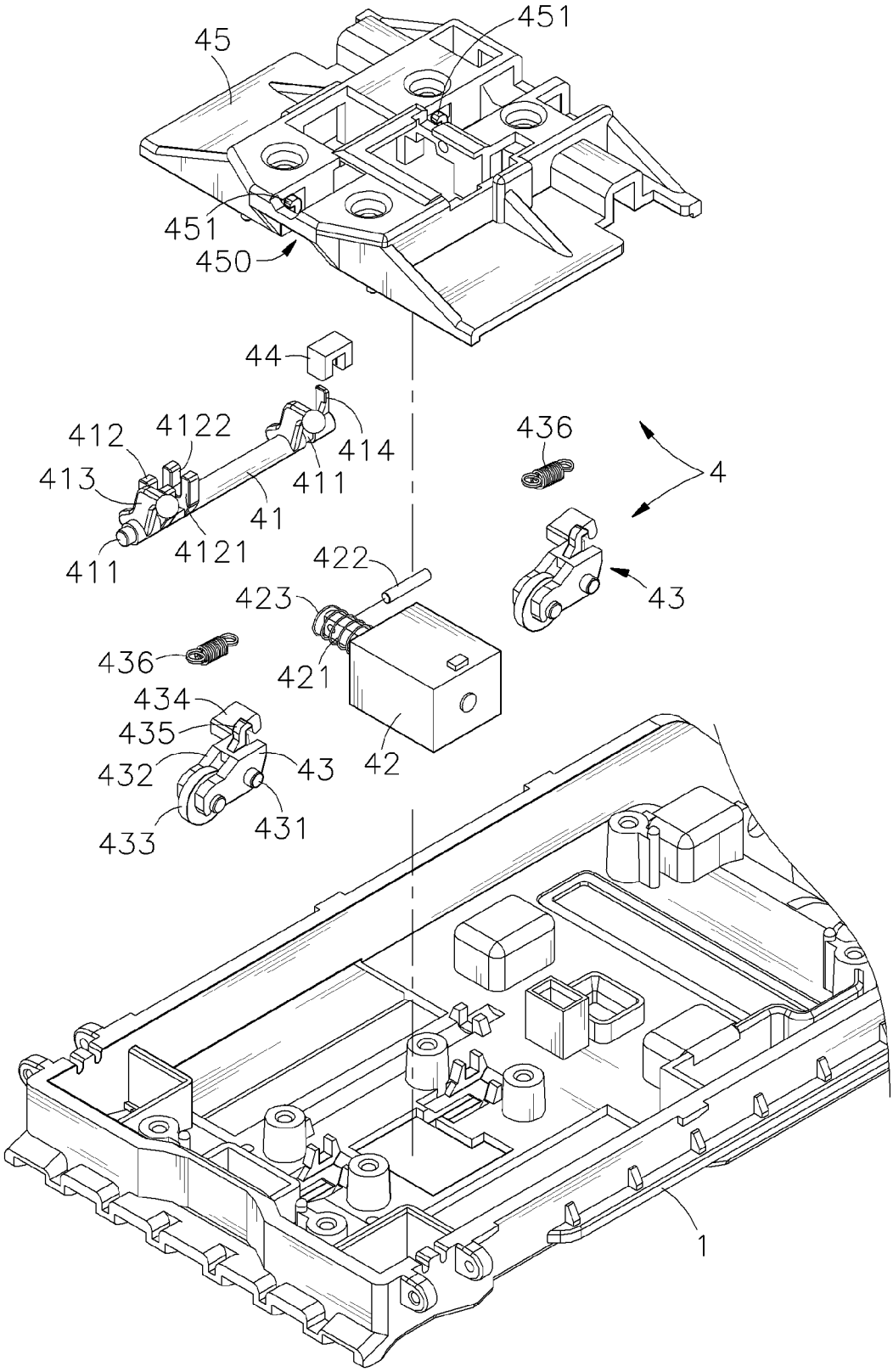
FIG. 3 is an exploded view in an enlarged scale of the movable bill impression mechanism of the bill position adjustment method and system in accordance with the present invention.
Figure 4:
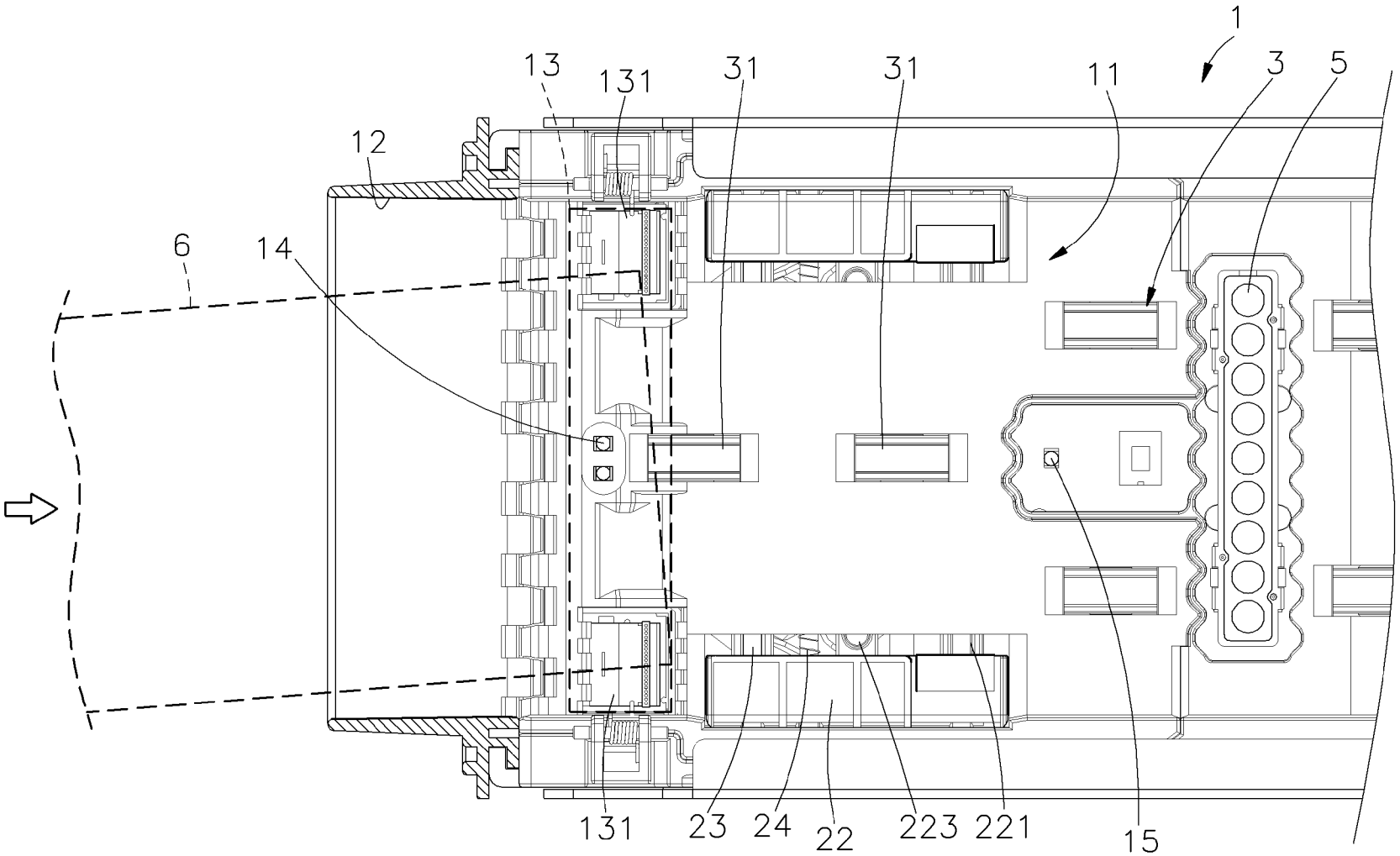
FIG. 4 is schematic top view of the bill position adjustment system in accordance with the present invention.
Figure 5:
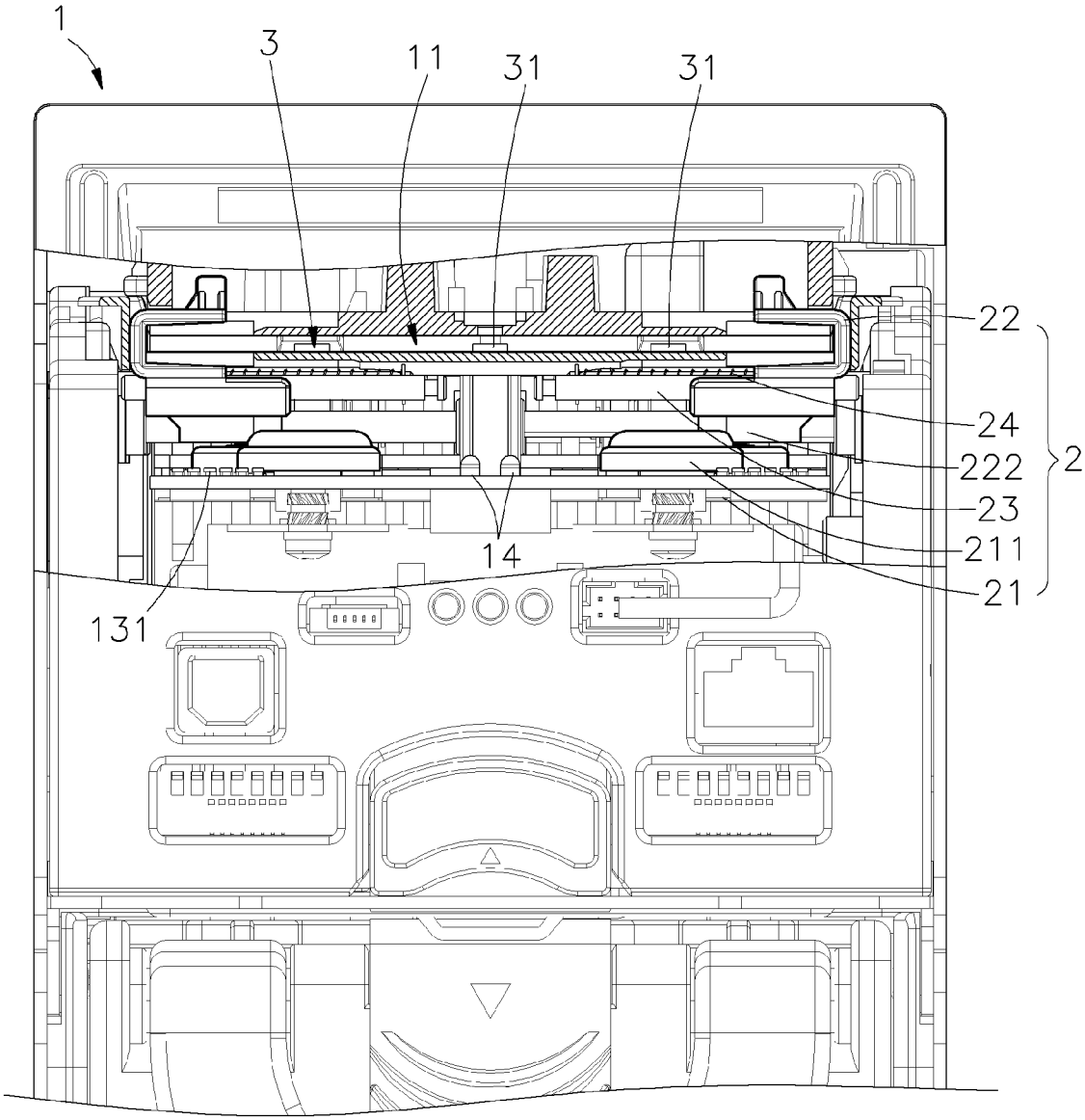
FIG. 5 is a schematic front view of the bill position adjustment system in accordance with the present invention.
Figure 6:
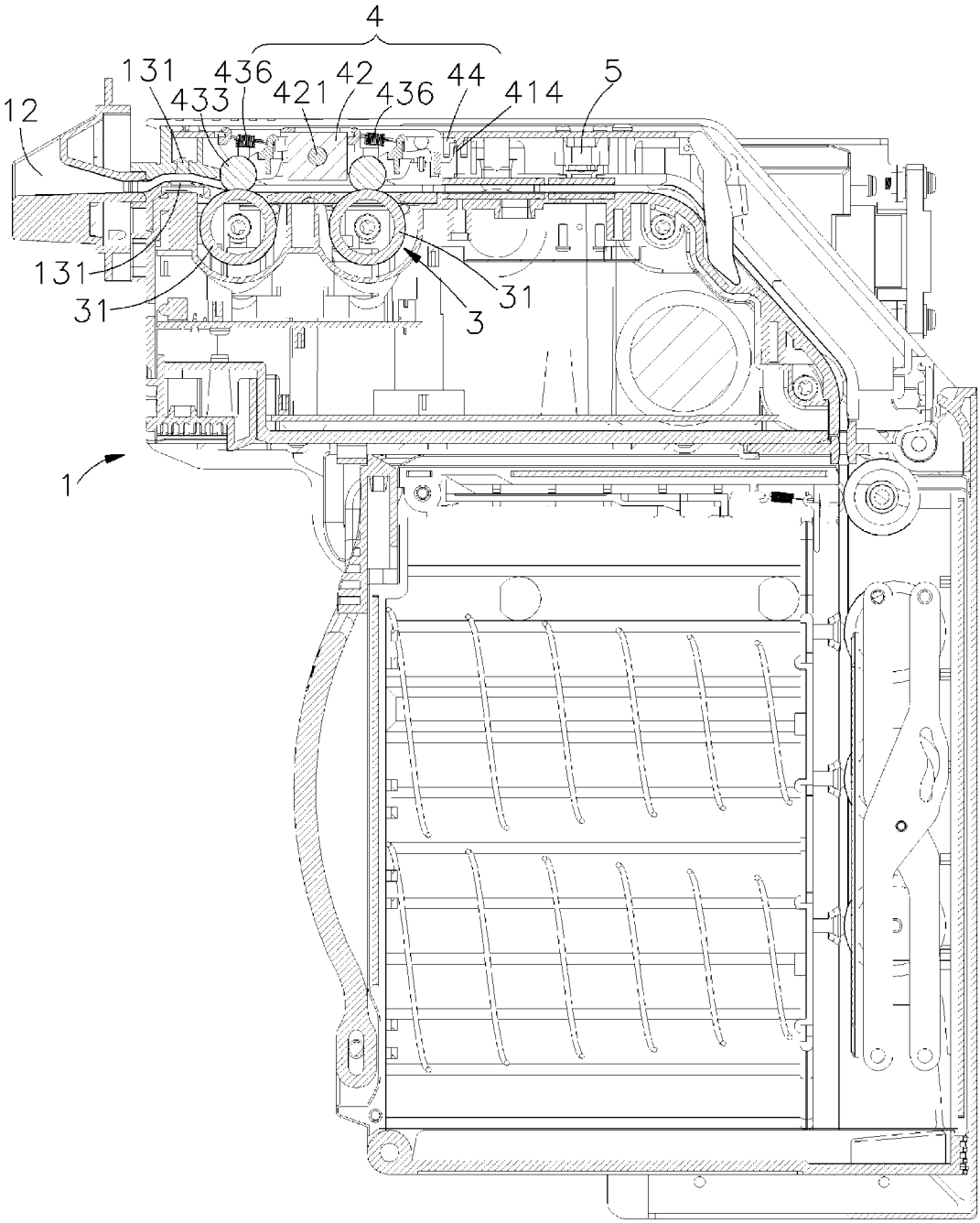
FIG. 6 is a sectional side view, in an enlarged scale, of the bill acceptor shown in FIG. 1.

Referring to FIGS. 1~6, a bill acceptor is shown comprising a body 1, a bill passage adjustment mechanism 2, a transmission mechanism 3, a movable bill impression mechanism 4 and a recognition device 5.

The body 1 comprises a bill passage 11 for allowing a bill 6 to pass, an insertion slot 12 extending to the outside and disposed in communication with the bill passage 11 for the insertion of a bill 6 into the bill passage 11, at least one, for example, a sensor zone 13 defined in an inner side of the insertion slot 12, at least one bill sensor 131 installed in the sensor zone 13 and adapted to detect the width and position of a bill 6 being inserted into the insertion slot 12, an entrance sensor 14 mounted in the rear side of the insertion slot 12 in front of the bill passage 11 and adapted to detect the presence of a bill 6, and a stoppage sensor 15 installed in a rear side of the bill passage 11 and adapted to detect stoppage of a bill 6.

The bill passage adjustment mechanism 2 is mounted in the body 1 between the entrance sensor 14 and the stoppage sensor 15 and adapted to adjust the width of the bill passage 11 subject to the control of the at least one sensor zone 13. The bill passage adjustment mechanism 2 comprises a plurality of driving devices 21 operable subject to the control of the at least one bill sensor 131, and a plurality of adjustment devices 22 respectively coupled to and movable by the driving devices 21 to adjust the width of the bill passage 11 subject to the control of the at least one bill sensor 131. The driving devices 21 are mounted in the bottom side of the bill passage 1, each comprising a rotary member 211 and two arms 2111 that are perpendicularly extended from the rotary member 211 and define therebetween a sliding way 2112. The adjustment devices 22 are respectively coupled to the driving devices 21 and suspending in the bill passage 11 at two opposite lateral sides of the bill passage 11, each comprising a plurality of sliding members 221 movable along fixed guide rods 23 in the bottom side of the bill passage 11, a barrel 222 vertically disposed on the middle, an axle 223 inserted through the barrel 222, and a bearing 224 mounted on the bottom end of the axle 223 and coupled to the sliding way 2112 between the two arms 211 of one associating driving device 21. Further, spring members 24 are respectively sleeved onto one of the fixed guide rods 23 and stopped against the adjustment devices 22.

The transmission mechanism 3 is mounted in the body 1 at one side, namely, the bottom side of the bill passage 11 behind the sensor zone 13 and at an inner side relative to the adjustment devices 22 of the bill passage adjustment mechanism 2, comprising a plurality of bill-transfer members 31 for transferring a bill 6 being inserted into the insertion slot 12. The bill-transfer members 31 can be rollers, rolling balls, transmission belts or any other devices capable for transferring a bill 6.

The movable bill impression mechanism 4 is mounted in the body 1 at the other side, namely, the top side of the bill passage 11, comprised of a rotary shaft 41, an electromagnetic valve 42, a plurality of impression wheel brackets 43 arranged at two sides relative to the electromagnetic valve 42, two sensor switches 44 and a cover 45. The rotary shaft 41 has two opposite coupling portions 411 respectively axially extended from the two distal ends thereof and pivotally coupled to the inside of the body 1, a plurality of coupling frames 412 extended from the periphery, a plurality of pressure arms 413 extended from the periphery and facing the impression wheel brackets 43, and a shield plate 414 perpendicularly extended from one coupling portion 411. The coupling frames 412 define therebetween a receiving space 4121. Further, each two adjacent coupling frames 412 have a notch 4122. The electromagnetic valve 42 comprises a reciprocating valve rod 421 inserted into the receiving space 4121 between the coupling frames 412 of the rotary shaft 41, a pin 422 transversely inserted through the reciprocating valve rod 421 and coupled to the notches 4122 of the two associating coupling frames 412, and a spring member 423 mounted on the reciprocating valve rod 421. Each impression wheel bracket 43 comprises two coupling rods 431 respectively pivotally coupled to the inside of the body 1, two suspension arms 432 respectively extended from the coupling rods 431, an impression wheel 433 pivotally coupled between the suspension arms 432 and suspending in the bill passage 11 inside the body 1, a bearing portion 434 extended in direction away from the suspension arms 432 for pressing by one pressure arm 413 of the rotary shaft 41, a locating member 435, and a spring member 436 connected with its one end to the locating member 435. The two sensor switches 44 are disposed at two sides relative to the shield plate 414 of the rotary shaft 41, and inducible by the shield plate 414 to control the operation of the electromagnetic valve 42. The cover 45 defines an accommodation space 450 for accommodating the rotary shaft 41, the electromagnetic valve 42 and the impression wheel brackets 43, and has locating members 451 for the connection of the other ends of the spring members 436 of the impression wheel brackets 43.

The recognition device 5 is installed in the body 1 behind the bill passage adjustment mechanism 2, having sensor means for detecting the anti-counterfeit characteristics of an inserted bill 6.

Figure 7:
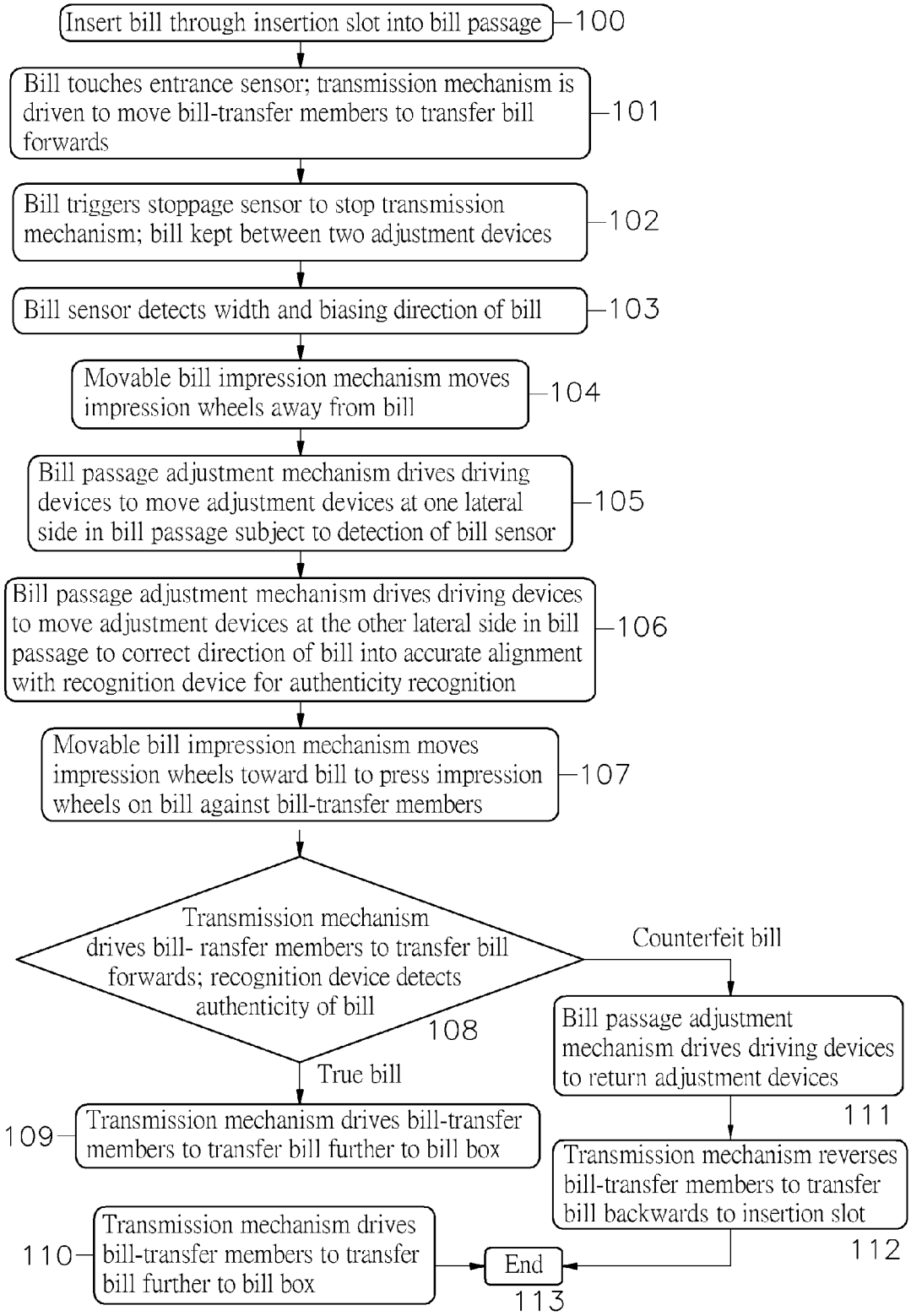
FIG. 7 is an operation flow chart of the bill position adjustment system in accordance with the present invention.

Referring to FIG. 7 and FIGS. 1~6 again, the bill position adjustment method runs subject to the following steps:

(100) Insert a bill 6 through the insertion slot 12 into the bill passage 11.

(101) The bill 6 touches the entrance sensor 14, and the transmission mechanism 3 is driven to move the bill-transfer members 31, transferring the bill 6 forwards toward the inside.

(102) The bill 6 triggers the stoppage sensor 15 to stop the transmission mechanism 3, keeping the bill 6 between two adjustment devices 22.

(103) The at least one bill sensor 131 in the sensor zone 13 detects the width and biasing direction of the bill 6.

(104) The movable bill impression mechanism 4 moves the impression wheels 433 away from the bill 6.

(105) The bill passage adjustment mechanism 2 drives the driving devices 21 to move the adjustment devices 22 that are arranged at one lateral side in the bill passage 11 subject to the detection of the at least one bill sensor 131.

(106) The bill passage adjustment mechanism 2 drives the driving devices 21 to move the adjustment devices 22 that are arranged at the other lateral side in the bill passage 11, thereby correcting the direction of the bill 6 into accurate alignment with the recognition device 5 for authenticity recognition.

(107) The movable bill impression mechanism 4 moves the impression wheels 433 toward the bill 6, pressing the impression wheels 433 on the bill 6 against the bill-transfer members 31.

(108) The transmission mechanism 3 drives the bill-transfer members 31 to transfer the bill 6 forwards, and at the same time the recognition device 5 detects the authenticity of the bill 6, and then proceed to step (109) if the bill 6 is recognized to be a true bill, or step (111) if the bill 6 is a counterfeit.

(109) The transmission mechanism 3 drives the bill-transfer members 31 to transfer the bill 6 further forwards to a bill box (not shown).

(110) The bill passage adjustment mechanism 2 drives the driving devices 21 to return the adjustment devices 22 to their former position where the bill passage 11 is in the widest condition. Thereafter proceed to step (113).

(111) The bill passage adjustment mechanism 2 drives the driving devices 21 to return the adjustment devices 22 to their former position where the bill passage 11 is in the widest condition.

(112) The transmission mechanism 3 reverses the bill-transfer members 31 to transfer the bill 6 backwards to the insertion slot 12.

(113) End.

Figure 8:
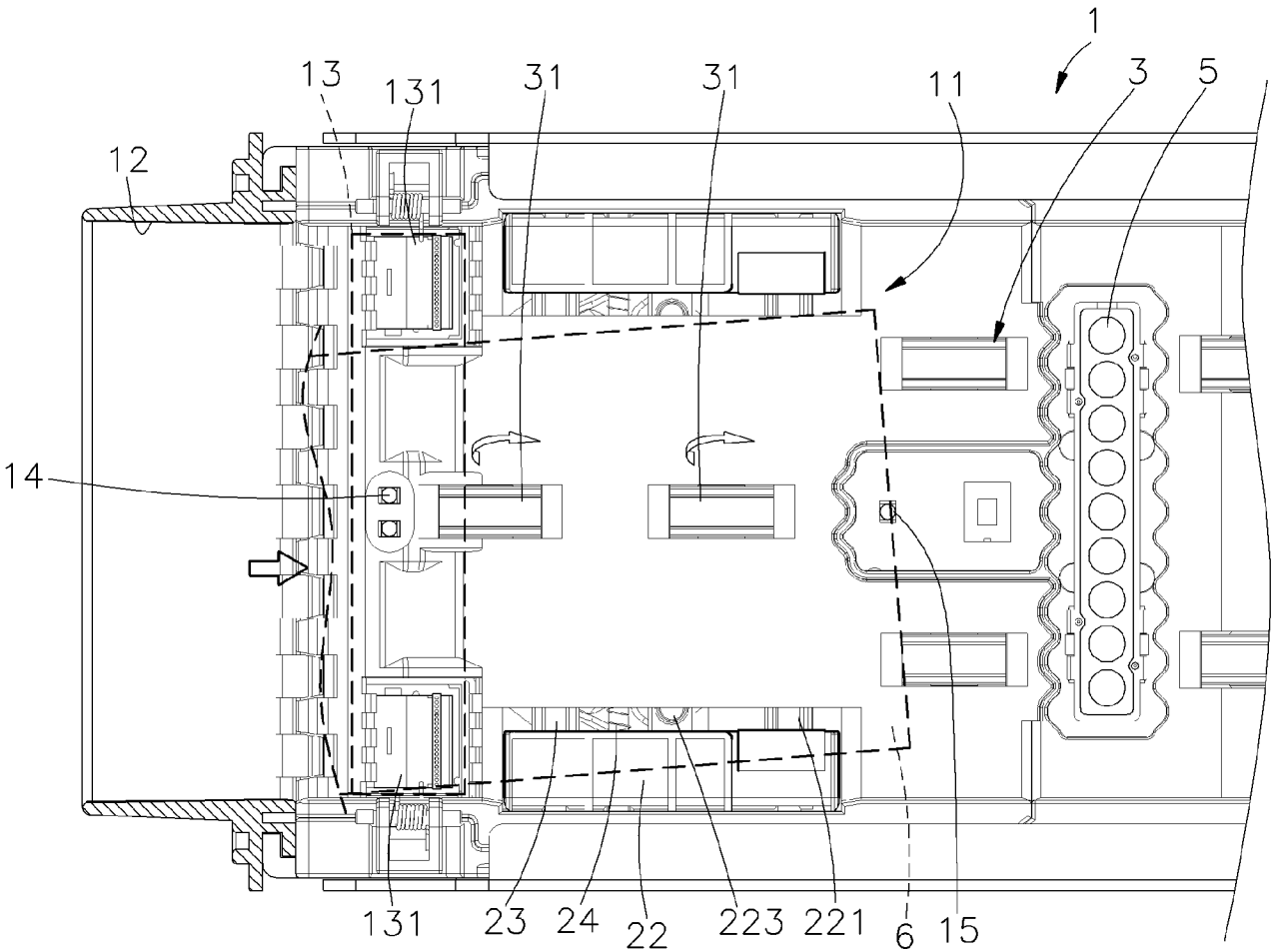
FIG. 8 is a schematic top view of the present invention, showing the bill position adjustment system in operation (I).
Figure 9:
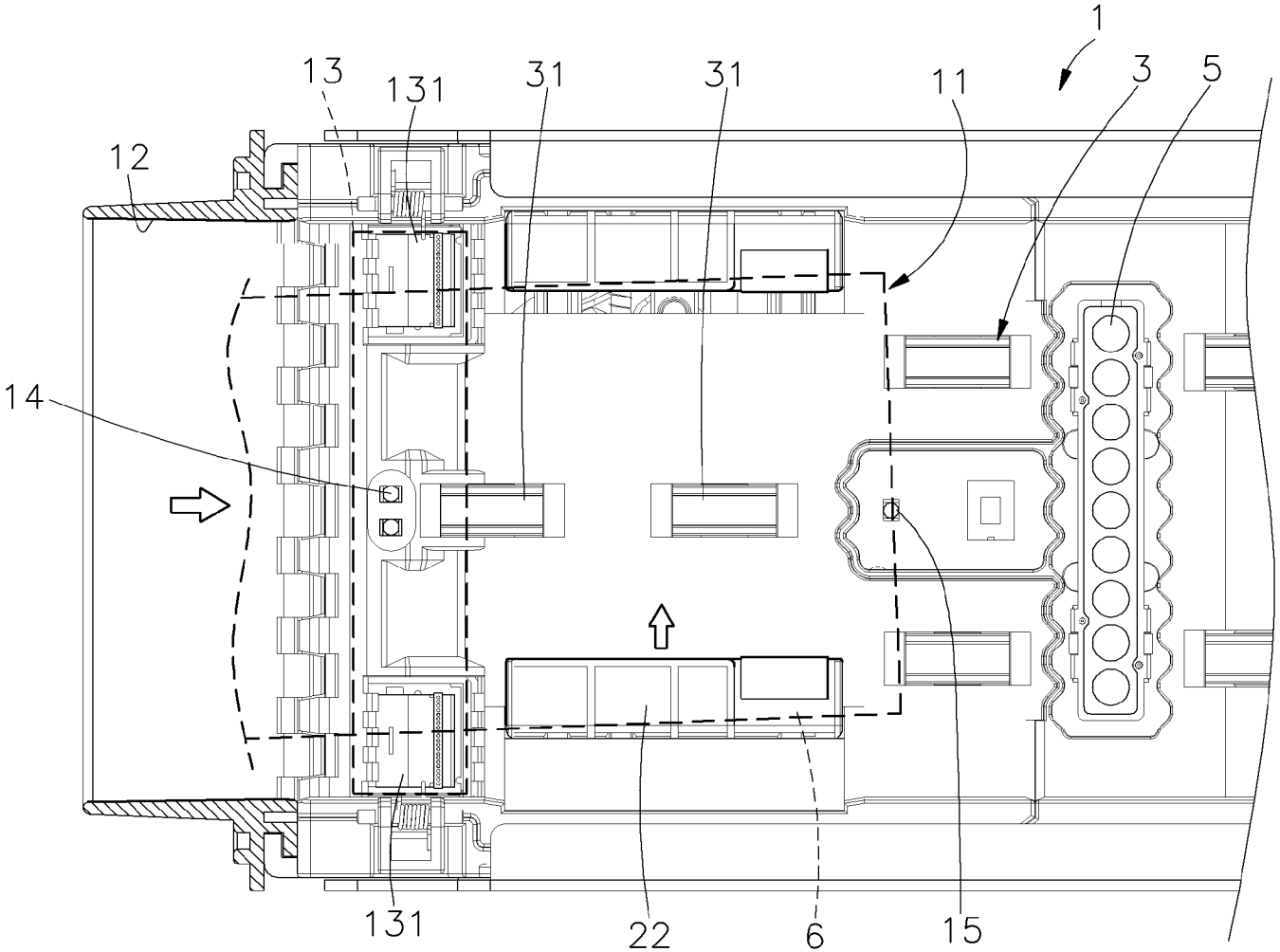
FIG. 9 is a schematic top view of the present invention, showing the bill position adjustment system in operation (II).
Figure 10:
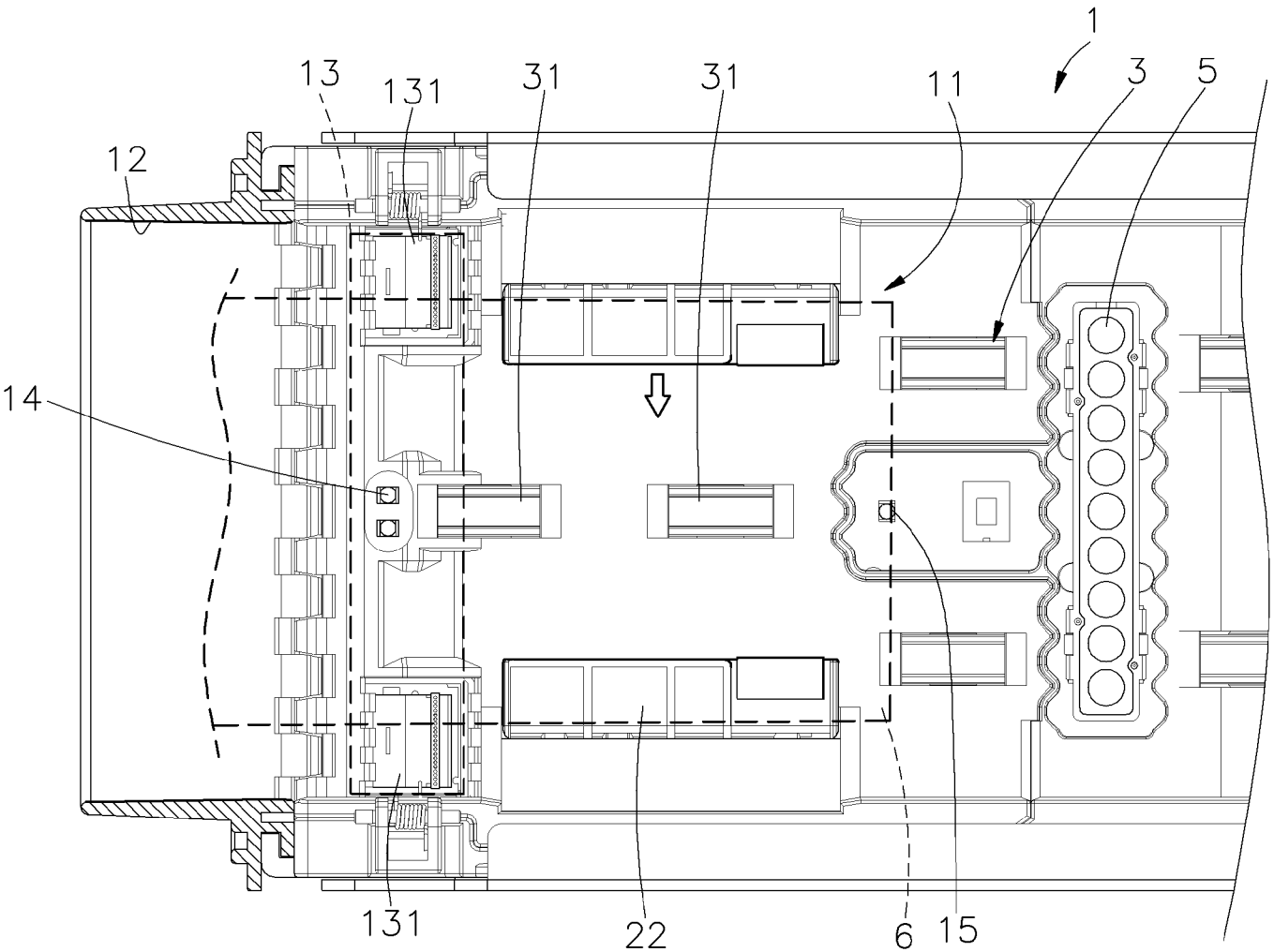
FIG. 10 is a schematic top view of the present invention, showing the bill position adjustment system in operation (III).

Referring to FIGS. 8~10 and FIGS. 1~4 again, when a bill 6 is inserted into the insertion slot 12 to touch the entrance sensor 14, the entrance sensor 14 outputs a signal, causing the transmission mechanism 3 to move the bill-transfer members 31 in transferring the bill 6 forwards. When the bill 6 touches the stoppage sensor 15, the stoppage sensor 15 outputs a signal to stop the transmission mechanism 3. When the transmission mechanism 3 is stopped, the bill 6 is kept between two adjustment devices 22, and the at least one bill sensor 131 in the sensor zone 13 detects the width and biasing direction of the bill 6 and provides the detection data to the control circuit (not shown) that controls the operation of the bill passage adjustment mechanism 2. At this time, the movable bill impression mechanism 4 moves the impression wheels 433 away from the bill 6, and the bill passage adjustment mechanism 2 drives the driving devices 21 to move the adjustment devices 22 that are arranged at one lateral side in the bill passage 11 subject to the detection of the at least one bill sensor 131 (in case the bill 6 is biased rightwards, the right-sided adjustment devices 22 are moved at first). Thereafter, the bill passage adjustment mechanism 2 drives the driving devices 21 to move the adjustment devices 22 that are arranged at the other lateral side in the bill passage 11, thereby correcting the direction of the bill 6 into accurate alignment with the recognition device 5 for authenticity recognition. After the direction of the bill 6 has been corrected and stopped between the adjustment devices 22 in accurate alignment with the recognition device 5, the movable bill impression mechanism 4 is driven to move the impression wheels 433 toward the bill 6, pressing the impression wheels 433 on the bill 6 against the bill-transfer members 31, and then the transmission mechanism 3 is driven to move the bill-transfer members 31 and to further transfer the bill 6 forwards, enabling the recognition device 5 to detect the authenticity of the bill 6.

When one driving device 21 is started, it rotates the rotary member 211, causing the two arms 2111 to move the bearing 224 of the associating adjustment device 22, and therefore the associating adjustment device 22 is forced to move with its sliding members 221 along the associating fixed guide rods 23. When the adjustment device 22 is moving along the associating fixed guide rods 23 in one direction, the spring members 24 are compressed. When the bill 6 is moved away from the space between the right-sided and left-sided adjustment devices 22, the spring members 24 force the associating adjustment device 22 back to its former position.

During the operation of the movable bill impression mechanism 4, the electromagnetic valve 42 is driven to retract the reciprocating valve rod 421 and the pin 422, causing the coupling frames 412 to be moved by the pin 422 in one direction, and therefore the rotary shaft 41 is biased in one direction. At this time, the pressure arms 413 are biased with the rotary shaft 41 in direction toward the bill passage 11 and pressed on the bearing portions 434 of the impression wheel brackets 43, thereby causing each impression wheel bracket 43 to turn in one direction, and therefore the impression wheel 433 is moved with the associating suspension arms 432 away from the bill passage 11. At this time, the bill 6 is released from the constraint of the bill-transfer members 31 and the impression wheel 433, and can be corrected to the accurate position by the adjustment devices 22.

When retracting the reciprocating valve rod 421 and the pin 422 to bias the rotary shaft 41, the spring member 423 is compressed. When the impression wheel brackets 43 are biased to move the associating impression wheels 433 away from the bill passage 11, the spring members 436 are compressed. After the adjustment devices 22 pushed the bill 6 into the accurate position, the electromagnetic valve 42 is stopped, the spring member 423 returns the rotary shaft 4 to its former position, and the spring members 436 return the impression wheel brackets 43 to their former position. At this time, the bill-transfer members 31 and the impression wheel 433 are respectively pressed on the top and bottom sides of the bill 6, enabling the bill 6 to be transferred forwards by the bill-transfer members 31.

As stated above, when a bill 6 is inserted into the insertion slot 12, the at least one bill sensor 131 in the sensor zone 13 is induced to detect the width of the bill 6, causing the bill passage adjustment mechanism 2 to adjust the width of the bill passage 11 subject to the detection of the at least one bill sensor 131. A database may be linked to the sensor zone 13. The database has stored therein data of widths, location of anti-counterfeit characteristics and location of value of different bills issued by a government or different governments. Subject to the data stored in the database, the at least one bill sensor 131 in the sensor zone 13 can accurately detect the width of a bill 6 being inserted into the insertion slot 12 so that the bill passage adjustment mechanism 2 can accurately adjust the width of the bill passage 11, avoiding a bill jam.

Further, the at least one bill sensor 131 in the sensor zone 13 can be a reflective sensor, penetrative sensor, contact image sensor (CIS), linear sensor or any other optical sensing device. The at least one bill sensor 131 can be installed in the bill passage 11 on the top, bottom, or one or both lateral sides, capable of accurately detecting the width and direction of the inserted bill 6.

Because the locations of the anti-counterfeit characteristics and value of different kinds of bills are different, different recognition devices may be necessary to detect the authenticity and value of different kinds of bills. The invention effectively eliminates the problem of using multiple recognition devices to detect different kinds of bill. By means of the at least one bill sensor 131 in the sensor zone 13 to detect the kind of each inserted bill 6 and to compare the detected data with storage data in the database, the adjustment devices 22 are accurately controlled to move the bill 6 into accurate alignment with the recognition device 5 for accurate recognition of the authenticity of the bill 6. Therefore, only one single recognition device 5 is necessary, saving much the manufacturing cost of the bill acceptor.

In conclusion, the invention provides a bill position adjustment method and system for bill acceptor that has the following advantages and features:

1. By means of the at least one bill sensor 131 in the sensor zone 13 to detect the width and biasing direction, the adjustment devices 22 are moved subject to the detection of the at least one bill sensor 131, thereby correcting the direction of the bill 6 into accurate alignment with the recognition device 5 for accurate recognition.

2. The bill passage adjustment mechanism 2 is controlled to move the adjustment devices 22 that are arranged at one lateral side in the bill passage 11 subject to the detection of the at least one bill sensor 131 in the sensor zone 13, and then to move the adjustment devices 22 that are arranged at the other lateral side in the bill passage 11, thereby correcting the direction of the bill 6 into accurate alignment with the recognition device 5 for authenticity recognition, avoiding wrinkling or biasing of the bill 6.

3. By means of the at least one bill sensor 131 in the sensor zone 13 to detect the width and biasing direction of an inserted bill 6 and the bill passage adjustment mechanism 2 to correct the direction of the bill 6 subject to the detection of the at least one bill sensor 131, one single recognition device 5 is sufficient to recognize different kinds of bill 6, saving much the cost of the bill acceptor.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A bill position adjustment method used in a bill acceptor for correcting the direction of an inserted bill, comprising the steps of:

(1) inserting a bill into an insertion slot of a bill acceptor;

(2) an entrance sensor being induced to drive a transmission mechanism upon inserting of said bill into said insertion slot, causing said transmission mechanism to transfer said bill forwards;

(3) a stoppage sensor being triggered to stop said transmission mechanism after said bill has been transferred forwards through a predetermined distance;

(4) at least one bill sensor in a sensor zone in said insertion slot being driven to detect the width and biasing direction of said bill;

(5) a movable bill impression mechanism being driven to move impression wheels away from said bill;

(6) a bill passage adjustment mechanism controlling driving devices to move first adjustment devices subject to the detection of said at least one bill sensor; and (7) said bill passage adjustment mechanism controlling said driving devices to move second adjustment devices opposite to said first adjustment devices to correct the direction of said bill into alignment with a recognition device;

wherein said at least one bill sensor in said sensor zone compares the detected bill width data with a storage data in a database to obtain the data of a predetermined bill width, location of bill anti-counterfeit characteristics and location of bill value of a predetermined bill, and then controls said bill passage adjustment mechanism to move said first and second adjustment devices in correcting the position of the inserted bill into accurate alignment with said recognition device subject to the data of the comparison result obtained.

2. The bill position adjustment method as claimed in claim 1, wherein said at least one bill sensor in said sensor zone controls said bill passage adjustment mechanism to move said first and second adjustment devices subject to the bill width data detected.

3. The bill position adjustment method as claimed in claim 1, wherein said transmission mechanism is controlled to transfer said bill forwards by means of a plurality of bill-transfer members.

4. The bill position adjustment method as claimed in claim 1, wherein said movable bill impression mechanism is driven to press impression wheels on said bill against bill-transfer members of said transmission mechanism and then said transmission mechanism is driven to move said bill-transfer members in transferring said bill forwards for recognition by said recognition device after said bill passage adjustment mechanism has moved said first and second adjustment devices to correct the direction of said bill into alignment with said recognition device.

5. The bill position adjustment method as claimed in claim 4, wherein said transmission mechanism is controlled to transfer said bill forwards to a bill box and then said bill passage adjustment mechanism is controlled to return said first and second adjustment devices to a maximum bill width position when said recognition device recognized said bill to be a true bill; said bill passage adjustment mechanism is controlled to return said first and second adjustment devices to a maximum bill width position and said transmission mechanism is controlled to reversely transfer said bill to said insertion slot when said recognition device recognized said bill to be a counterfeit.

* * * * *